US006604880B1

(12) United States Patent
Huang et al.

(10) Patent No.: US 6,604,880 B1
(45) Date of Patent: Aug. 12, 2003

(54) MOTION LIGHTING PEN WITH LIGHT VARIABLY ACCOMPANYING SOUND ACTUATION

(75) Inventors: Fang-Yue Huang, Hsinchu (TW); Wen-Chen Chung, Hsinchu (TW)

(73) Assignee: Excellence Optoelectronics, Inc., Hsinchu (TW)

( * ) Notice: Subject to any disclaimer, the term of this patent is extended or adjusted under 35 U.S.C. 154(b) by 0 days.

(21) Appl. No.: 10/167,632

(22) Filed: Jun. 13, 2002

(51) Int. Cl.[7] ..... D43K 29/00
(52) U.S. Cl. ..... 401/195; 362/118
(58) Field of Search ..... 401/195, 52; 362/118, 362/109, 119; 340/384.1

(56) References Cited

U.S. PATENT DOCUMENTS 4,763,355 A * 8/1988 Cox ..... 379/355
4,812,068 A * 3/1989 Seong ..... 401/195
5,313,557 A * 5/1994 Osterhout ..... 395/2.81
5,405,207 A * 4/1995 Zubli ..... 401/110
6,261,018 B1 * 7/2001 Chen ..... 401/195

* cited by examiner

*Primary Examiner*—David J. Walczak
(74) *Attorney, Agent, or Firm*—Johnson & Associates, PC; Chauncey B. Johnson, Esq.

(57) ABSTRACT

A pen with both music and motion lighting function but capable of emitting multiple color light source variably accompanying the cadence or rhythm of pleasant played music for fascination, enjoyment and amusement of individual's sight and hearing. A music-light generating means disclosed is fitted into a tubular cylindrical holder invented as a sound box to have sounds generated from the music-light generating means resonate to enhance hearing and overall sound output.

4 Claims, 4 Drawing Sheets

MOTION LIGHTING PEN WITH LIGHT VARIABLY ACCOMPANYING SOUND ACTUATION

BACKGROUND OF THE INVENTION

1. Field of the Invention

The present invention relates to a pen with motion light variably accompanying sound melody. More specifically, the present invention relates to a pen with tubular cylindrical holder invented as a sound box to resonate music and with multiple colors lighting variably accompanying the rise and fall of played music.

2. Description of Related Art

As well-known in the art, a variety of writing tools such as pens have been developed for use under different conditions or for different purposes. For example, a light pen has an illuminator attached thereto, a laser pointer pen has a laser point attached thereof, a sound generating pen has a sound producer attached therein, and even a pen with both sound and illumination function is disclosed in U.S. Pat. No. 6,261,018 issued to Chen.

This present invention provides an improvement and new pen structure design relative to designs of the prior art. The pen structure of this invention is not only designed to have both sound and illumination function but is capable of emitting changeable multiple color light sources corresponding to the musical scale of sound or music played to attract an audience for amusement purposes. In addition, the assembly structure of this present invention is uniquely invented in a very narrow space of the pen. In contrast, prior art devices which produce somewhat similar sound and illumination function are very large and cumbersome as compared to the pen of this present invention, with a tubular cylindrical holder, which is invented as a sound box to resonate sweeter sound than its prior art counterparts.

The pen of this invention may be used as gifts for families, relatives and friends, especially for seasonal greetings during holidays. The invention can be used to play Christmas songs and melody lighting for the Christmas season and love songs for Valentine's day, etc. It may also be used as a personal amusement tool for playing music and looking at motion lighting while writing or simply enjoying sound-light amusement.

SUMMARY OF THE INVENTION

An object of this invention is to provide a pen with both music and motion lighting function capable of emitting multiple color light sources variably accompanying the cadence or rhythm of pleasant music for fascination, enjoyment and amusement of individuals sight and hearing.

Another object of this invention is invent a music-light generating means capable of emitting multiple color light sources variably accompanying the cadence or rhythm of pleasant played sound; the invention is fitted into a tubular cylindrical holder used as a sound box to resonate those sounds generated from the music-light generating means.

The features and advantages of this invention are described in this specification in conjunction with the drawings illustrating a preferred embodiment of the invention.

BRIEF DESCRIPTION OF THE DRAWINGS

Other aspect of this invention will become more apparent from the following detailed description when taken in conjunction with the accompanying drawings, in which.

DETAILED DESCRIPTION OF THE PREFERRED EMBODIMENTS

Figure 1:
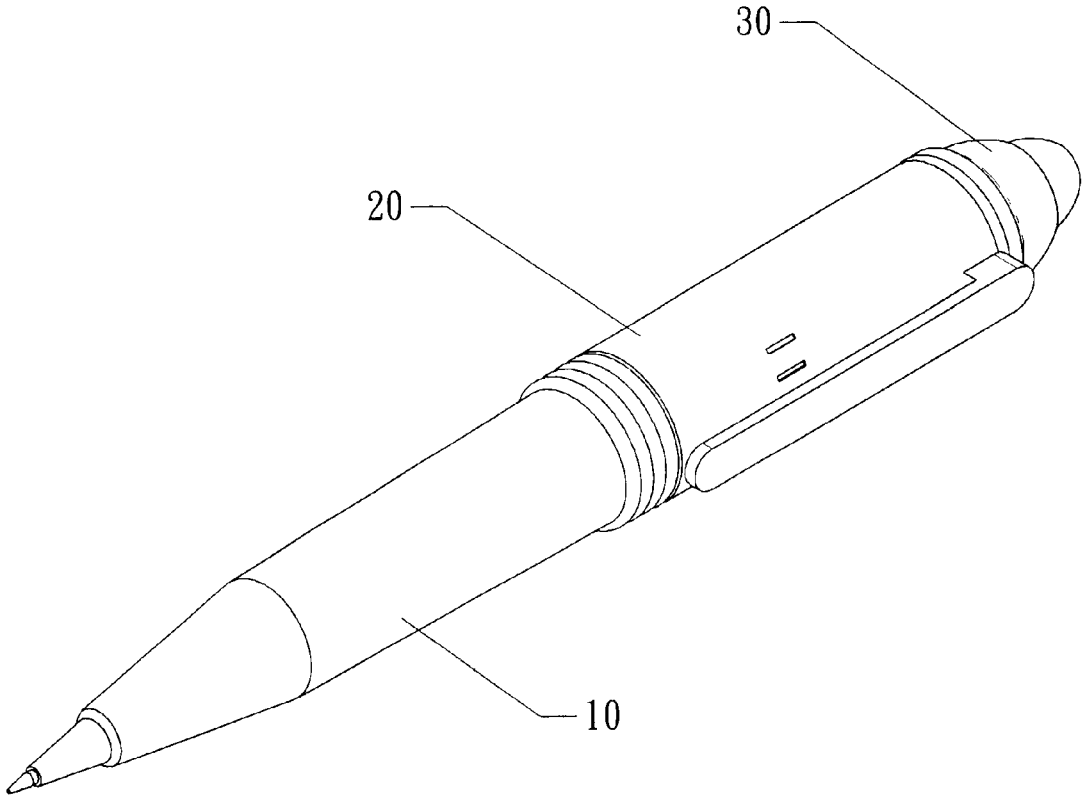
FIG. 1 is a pictorial view of pen in accordance with the present invention.
Figure 2:
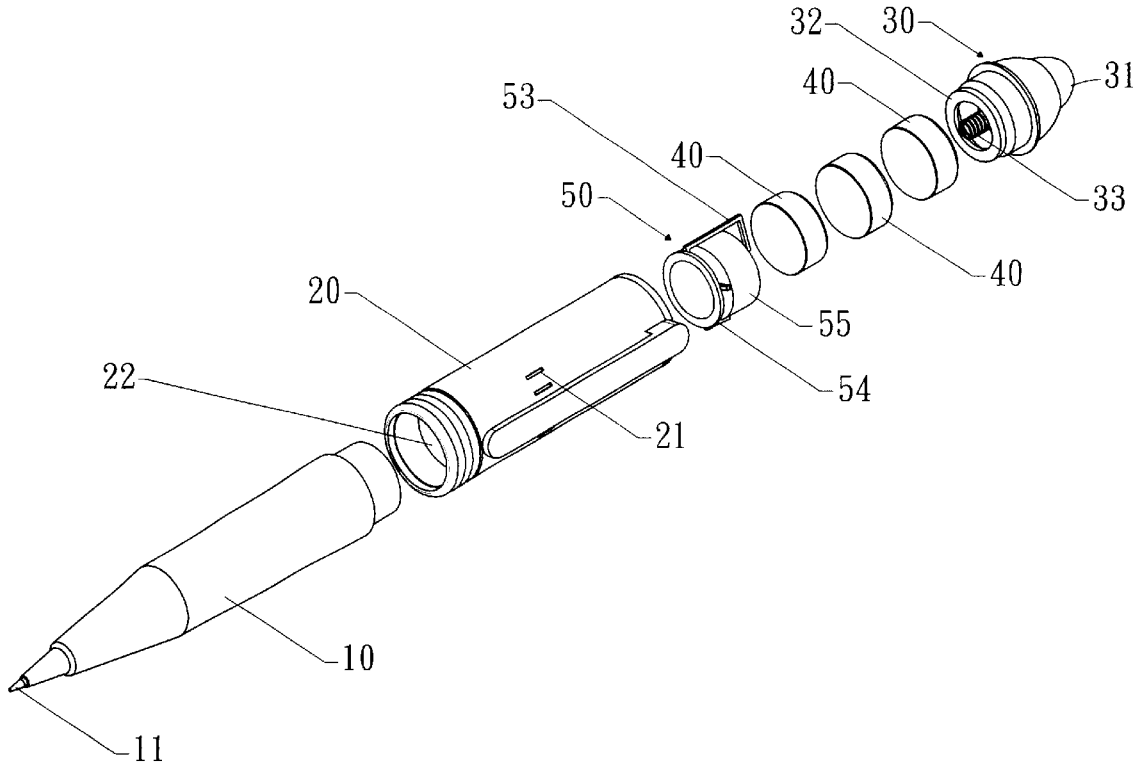
FIG. 2 is an exploded view of the pen in FIG. 1.
Figure 3:
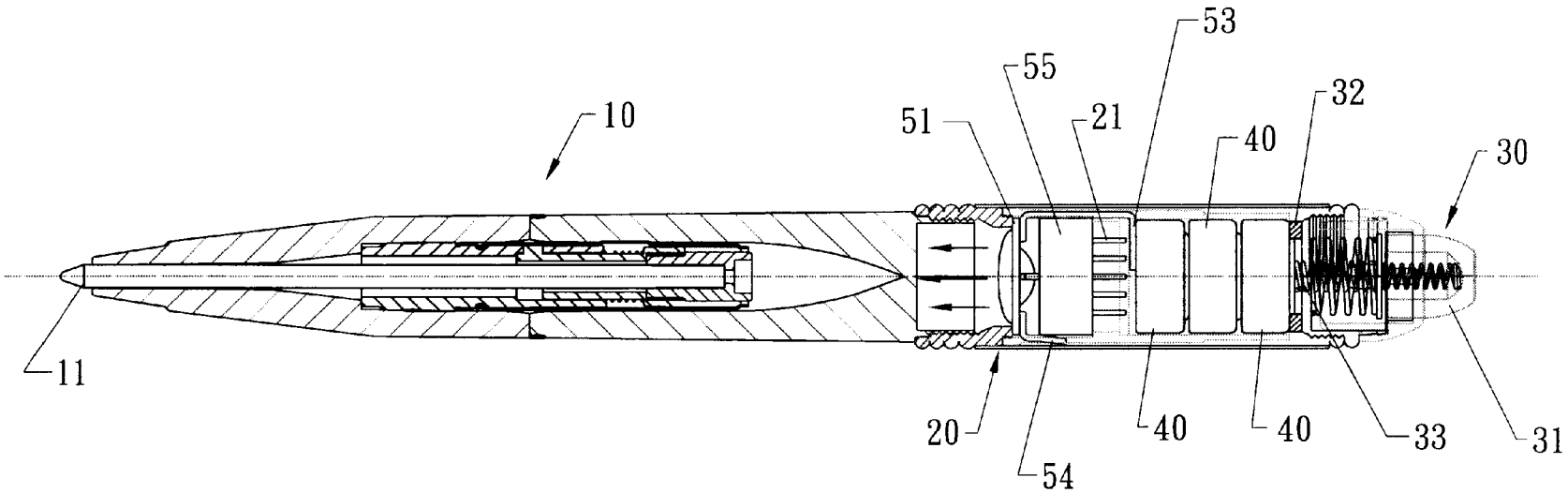
FIG. 3 is a longitudinal cross-section view of the pen in FIG. 1 showing the internal assembly structure of the present invention.

With reference to FIGS. 1, 2 and 3, the present invention provides a pen with multiple lighting colors variably accompanying sound actuation basically comprising at least a pen body 10, a tubular cylindrical holder 20 and a pen head 30.

The pen body 10 is adapted to receive a writing cartridge 11 therein and is made of a transparent material such as transparent plastic in order to guide the light source, generated by a music-light generating means 50 of the invention, and to diffuse the light source emitted outwards.

The tubular cylindrical holder 20, connected to the top of said pen body 10, is provided with a hollow chamber 22 formed like a sound box for resonance so that several sound holes 21 are opened and properly positioned on its surface for generating sweet sounds resonating inside said chamber. Also, the tubular cylindrical holder 20 of the invention is especially made of metal material making its surrounding walls capable of electrical conduction.

Figure 4:
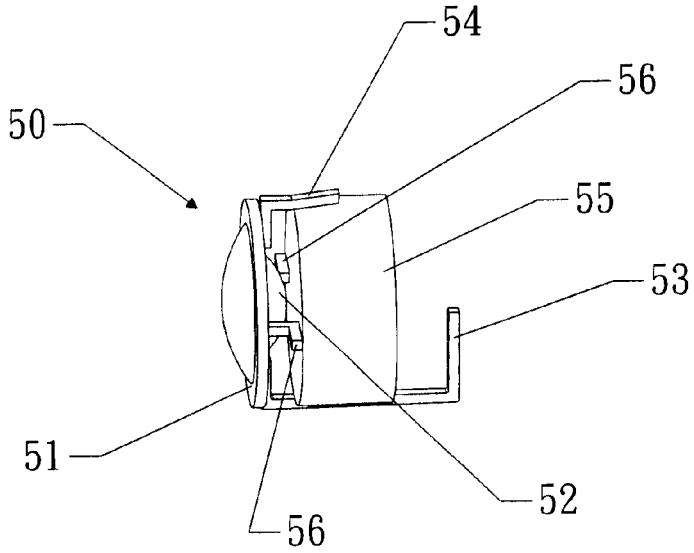
FIG. 4 is a pictorial view of a music-light generating means of the present invention.

With reference to FIGS. 2, 3 and 4, a music-light generating means 50, capable of generating sound and light simultaneously, includes a multicolor LED base 51, an integrate circuit 52 directly installed on the bottom of said multicolor LED 51, an electro-magnetic transducer 55 with a pair of connecting feet 56 connected to said beak) multicolor LED base 51 and said integrate circuit 52, and a pair of bending positive electrode 53 and inclined negative electrode 54. The outer dimension of said music-light generating means 50 is properly smaller than the interior dimension of the tubular cylindrical holder 20 in such a manner as to define said music-light generating means 50 positioned therein.

Figure 5:
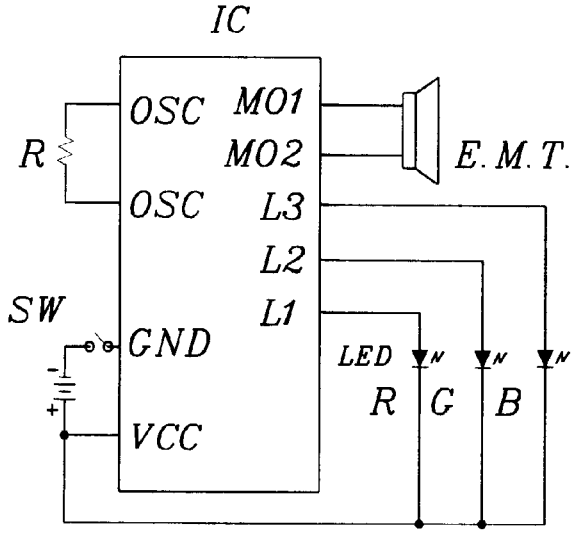
FIG. 5 is a layout drawing of an Integrated Circuit used in the music-light generating means shown in FIG. 4.

With reference to FIGS. 4 and 5, said multicolor LED base 51 contains a plurality of LED chips capable of generating different color of light source. The practical embodiment of the invention is to provide multiple LED chips, including at least red LED chip, green LED chip and blue LED chip connected to L1, L2 and L3 of said integrate circuit 52 shown in FIG. 5 to generate multiple colors corresponding to the musical scale of music. The multiple colors lighting may be emitted by multiple chips on board, Surface Mounted Devices or multiple through-hole lamps. Under the control of predetermined programs of said integrate circuit 52 and according the cadence or rhythm of song or music, each single LED chip may be alternately selected in such a way to emit its own mono-color light, or two or more single LED chip may be alternately selected in such a way to simultaneously emit and mix their own mono-color lights as other different color lights. Therefore, said multi-color LED base 51 of the invention is capable of generating at least seven color light sources which variably accompanies the rise and fall of sound or music played by the programs of said integrate circuit 52.

The electro-magnetic transducer 55 of the invention, is not like a buzzer or a sound generating device commonly used in several prior art. The prior art invention are designed without sound resonating media; therefore, sounds generated are almost hardly heard because they are not generated through resonance sound media. In contrast, the tubular cylindrical holder 20 of the invention is invented as a sound resonance box which is used as a sound resonance medium for said electro-magnetic transducer 55 to generate sound by resonance effect. Using the tubular cylindrical holder 20 as a resonance box constitutes a drastic and very important improvement over the prior art. Using the resonance medium of this invention sound is generated from said electro-magnetic transducer 55 and transmitted through said sound hole 21 of said tubular cylindrical holder 20 thereby producing outward sweeter sound than that of the prior art.

The electro-magnetic transducer (referred as E.M.T.) 55 of the invention provides a pair of connecting feet 56 connected to said multicolor LED base 51 as shown in FIG. 4, and said pair of connecting feet 56 is respectively connected to the M01 (Music Output 1) and M02 (Music Output 2) of said integrate circuit 52 as shown in FIG. 5. Accordingly, under the control of said integrate circuit 52 of the invention, said music-light generating means 50 may be reduced to practice and simultaneously generate pleasant sound or music for hearing and for synchronously accompanying the variety of cadence or rhythm of sound or music played to emit at least seven different color light sources for sight purposes, when power is supplied through said bending positive electrode 53 and said inclined negative electrode 54 to said music-light generating means 50.

The bending positive electrode 53, with both ends bent, is connected to VCC of said integrate circuit 52 by its one end as shown in FIG. 5, and its other end is positioned on the position above the top of said electro-magnetic transducer 55. In order to prevent short circuiting, the shape of said bending positive electrode 53 is desired to be kept at a distance from both said tubular cylindrical holder 20 and said electro-magnetic transducer 55 as shown in FIG. 3. The inclined negative electrode 54 is folded into an inclined shape, wherein one electrode is connected to GND of said integrate circuit 52 as shown in FIG. 5, and the inclined end is positioned on the position against the surrounding walls of said tubular cylindrical holder 20 for conductance when said music-light generating means 50 is securely positioned inside the chamber of said tubular cylindrical holder 20 as shown in FIG. 3.

Referring to FIGS. 2 and 3, a set of batteries 40, used as a power source of said music-light generating means 50 are connected to said bending positive electrode 53 with their positive electrode. When both said music-light generating means 50 and said batteries 40 are fitted into the chamber 22 of said tubular cylindrical holder 20, a pen head 30, made of metal material, is used to fasten on the top end of said tubular cylindrical holder 20 to completely form said chamber of said tubular cylindrical holder 20 as a sound box, and simultaneously to secure said music-light generating means 50 and said batteries 40 in their proper positions by way of a insulator 32 installed on front end of said pen head 30 securely against the top of said batteries 40. The pen head 30 is also provided with a push-button switch 31 whose bottom has a connecting spring 33 to serve as a contact with said batteries 40.

When push-button switch 31 is pushed down the connecting spring 33 is moved down and is totally against the top of the batteries 40. A close circuit conductance path is constituted by said connecting spring 33, said pen head 30 made of metal, said tubular cylindrical holder 20 made of metal, said music-light generating means 50 (through said inclined negative electrode 54, said integrate circuit 52, said bending positive electrode 53), and said batteries 40. Thus, once supplied power from said batteries 40 is provided said music-light generating means 50 immediately activates said multicolor LED base 51 capable of generating up to seven color light sources variably accompanying the cadence or rhythm of sound or music played according to predetermined programs of the integrate circuit 52.

When the push-button switch 31 is pushed again, said connecting spring 33 of said push-button switch 31 is released and a gap is maintained from the top of said batteries 40. The power from said batteries supplied to said music-light generating means 50 is stopped so that those different color light sources variably accompanying the cadence or rhythm of sound or music played are deactivated.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

What I claimed is:

1. A motion lighting pen with light variably accompanying sound actuation, at least comprising:

a pen body made of a transparent material to guide or diffuse different color light sources;

a tubular cylindrical holder made of metal and connected to said pen body which is provided with a hollow chamber used as sound box for resonance and several sound holes are opened on its surface;

a music-light generating means fitted into the chamber of said tubular cylindrical holder having a multicolor LED base for emitting different color light sources, an integrate circuit installed on the bottom of said multicolor LED to control different color light sources emitted variably accompanying the cadence or rhythm of sound played, an electro-magnetic transducer without sound resonating media and with a pair of connecting feet connected to said integrate circuit, and a pair of electrodes connected to said integrate circuit;

a set of batteries in series connected to said positive electrode of said music-light generating means with their positive electrode; and a pen head, made of metal and fasten on the top end of said tubular cylindrical holder, having a insulator installed on front end capably against the top of said batteries for position, and a push-button switch with a connecting spring as a contact to said batteries.

2. The pen with light variably accompanying sound actuation according to claim 1, wherein said music-light generating means having a multicolor LED base with multiple chips connected to said integrate circuit for emitting multiple color light sources.

3. The pen with light variably accompanying sound actuation according to claim 2, wherein said music-light generating means having a bending positive electrode kept at a distance from both said tubular cylindrical holder and said electro-magnetic transducer, wherein one end is connected to VCC of said integrate circuit and another end is positioned on the position above the top of said electro-magnetic transducer, and a inclined negative electrode with one end connected to GND of said integrate circuit and the other end positioned against the surrounding walls of said tubular cylindrical holder for conductance.

4. The pen with light variably accompanying sound actuation according to claim 1, wherein said music-light generating means having a bending positive electrode kept at a distance from both said tubular cylindrical holder and said electro-magnetic transducer, wherein one end is connected to VCC of said integrate circuit and another end is positioned on the position above the top of said electromagnetic transducer, and a inclined negative electrode with one end connected to GND of said integrate circuit and the other end positioned against the surrounding walls of said tubular cylindrical holder for conductance.

* * * * *